US005155896A

United States Patent [19]

Pai

[11] Patent Number: 5,155,896

[45] Date of Patent: Oct. 20, 1992

[54] METHOD OF MANUFACTURING THE THROAT PORTION OF AN ALUMINUM RACKET

[76] Inventor: Chin-Dong Pai, No. 3, Yu San Rd., Yu Shih Industrial District, Ta Chia Chen, Taichung Hsien, Taiwan

[21] Appl. No.: 747,331

[22] Filed: Aug. 20, 1991

[51] Int. Cl.[5] ..... B21D 35/00; A63B 49/10

[52] U.S. Cl. ..... 29/469.5; 29/446; 29/458; 273/73 G

[58] Field of Search ..... 29/446, 447, 448, 449, 29/458, 469.5, DIG. 29, DIG. 1, 460; 156/245; 264/257, 258; 273/73 R, 73 F, 73 G, 73 C, 73 H, 73 J, 73 K

[56] References Cited

U.S. PATENT DOCUMENTS 2,178,588 11/1939 Kleinman ..... 273/73 G X
3,612,526 10/1971 Brull ..... 273/73 G X
3,993,308 11/1976 Jenks ..... 273/73 F
4,177,990 12/1979 Kajiwara ..... 273/73 C
4,506,887 3/1985 Trysinsky ..... 273/73 G X
4,684,131 8/1987 Mortvedt ..... 273/73 F
4,725,059 2/1988 Gardin et al. ..... 273/73 C X

FOREIGN PATENT DOCUMENTS 218170 12/1984 Japan ..... 273/73 F

*Primary Examiner*—Joseph M. Gorski
*Assistant Examiner*—Peter Dungba Vo
*Attorney, Agent, or Firm*—Kenyon & Kenyon

[57] ABSTRACT

A method of making a metal racket including wrapping around a foamable material a shell of composite material, splitting each end of the shell so that two pieces are formed on each end of the shell, attaching the pieces of the shell to the throat portion of the racket, wrapping around the pieces of the shell and the throat portion with an outer layer which is made of composite material, hot-pressing the racket and the shell in order to foam the foamable material and in order to cure the shell so that the shell can be formed integral with the racket as a yoke of the racket.

1 Claim, 4 Drawing Sheets

METHOD OF MANUFACTURING THE THROAT PORTION OF AN ALUMINUM RACKET

BACKGROUND OF THE INVENTION

1. Field of the Invention

The present invention relates to a method, and more particularly to a method for manufacturing the throat portion of a racket, such as tennis racket, squash racket and badminton racket, which is particularly made of metal materials including steel, aluminum, titanium etc.

2. Description of the Prior Art

Typical tennis racket, as shown in FIG. 1, comprises a frame 10 having an approximately oval-shaped or ovaloid head portion terminating in a pair of closely spaced sloping extensions forming a throat portion 12 of the racket. A separate throat piece or yoke 20 is disposed to the inner sides of the sloping frame extensions at the throat portion 12. The oval-shaped portion 10 of the frame, including a head portion and the yoke defines a striking area or playing face of the racket which is comprised of main or long strings and cross or short strings, both being in tightly stretched state. The sloping frame extensions are coupled side by side in one body with each other to form a handle or shaft portion 14 of the racket, the end portion of which is encased by a grip portion.

For a tennis racket which is made of metal materials, as shown in FIG. 5, the yoke 40 is preformed separately and is fixed to the inner sides of the sloping frame extensions at the throat portion 12 of the racket by such as screws 42 and by adhesive materials. After long term of using, the yoke 40 is apt to become loose and is apt to be separated from the frame 10.

The present invention has arisen to mitigate and/or obviate the afore-described disadvantages of the conventional metal rackets.

SUMMARY OF THE INVENTION

The primary objective of the present invention is to provide a method for manufacturing the throat portion of the metal racket in which the yoke can be integrally formed with the frame of the racket.

In accordance with one aspect of the invention, there is provided a method for manufacturing a throat portion of a racket which is made of metal material, the racket including a frame having an approximately oval-shaped head portion terminating in a pair of closely spaced sloping extensions forming the throat portion of the racket, the method including preparing a foamable material, wrapping around the foamable material a shell which is made of composite material and resin-coated, the shell including two end portions, splitting each of the end portions of the shell so that a pair of pieces are formed on each end portion of the shell, attaching the pieces of each of the end portions of the shell to an inner surface of a respective sloping extension at the throat portion of the racket, wrapping around the pieces of the shell and the sloping extensions with an outer layer which is made of composite material and resin-coated, hot-pressing the racket and the shell in order to foam the foamable material and in order to cure the shell so that the shell can be formed integral with the racket as a yoke of the racket.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
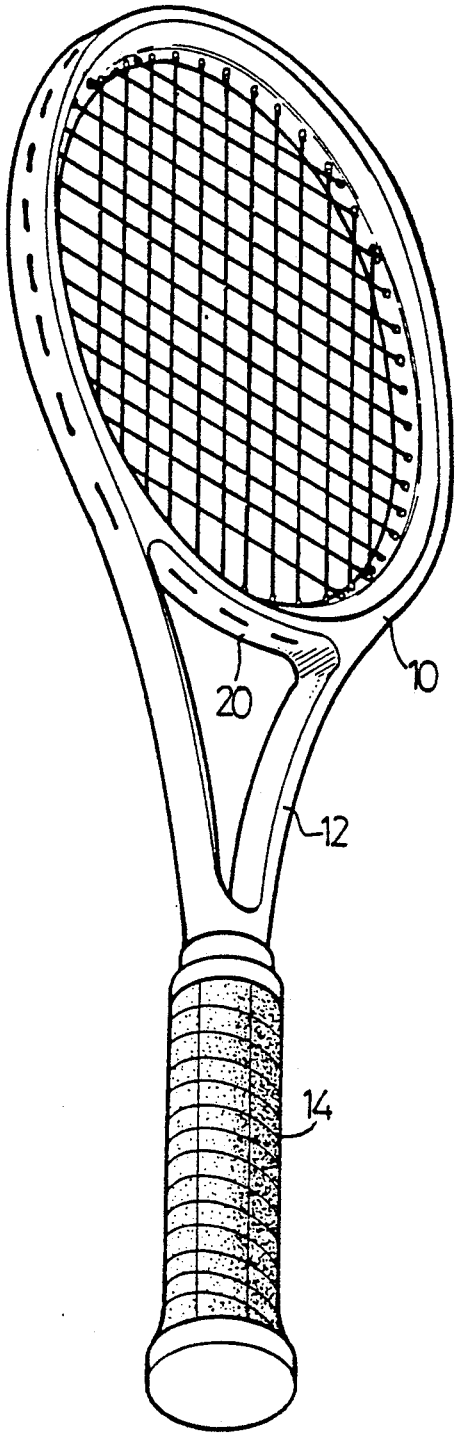
FIG. 1 is a perspective view of a tennis racket.

Referring to the drawings and initially to FIG. 1, a typical tennis racket comprises a frame 10 having an approximately oval-shaped or ovaloid head portion terminating in a pair of closely spaced sloping extensions forming a throat portion 12 of the racket. A separate throat piece or yoke 20 is disposed to the inner sides of the sloping frame extensions at the throat portion 10. The oval-shaped portion 10 of the frame, including a head portion and the yoke defines a striking area or playing face of the racket which is comprised of main or long strings and cross or short strings, both being in tightly stretched state. The sloping frame extensions are coupled side by side in one body with each other to form a handle or shaft portion 14 of the racket, the end portion of which is encased by a grip portion.

The method in accordance with the present invention is generally provided for manufacturing the throat portion of the metal racket, and particularly provided for fixing the yoke to the inner sides of the sloping frame extensions at the throat portion of the racket.

Figure 2:
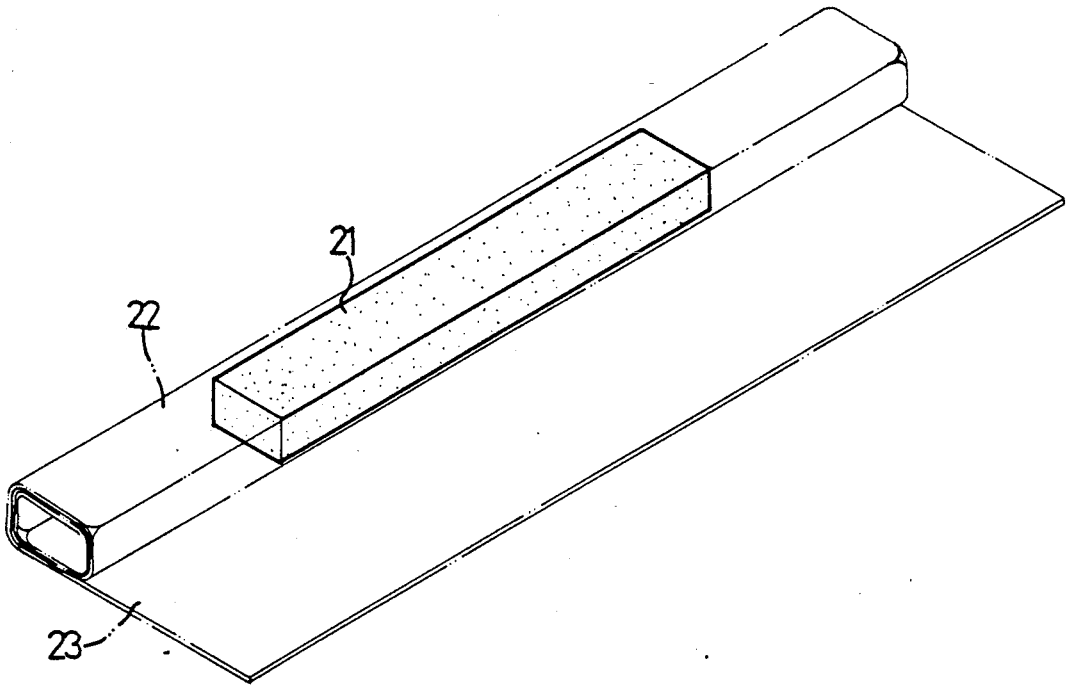
FIG. 2 is a perspective view illustrating a foamable material surrounded by a shell of composite materials which is shown in dotted lines.
Figure 3:
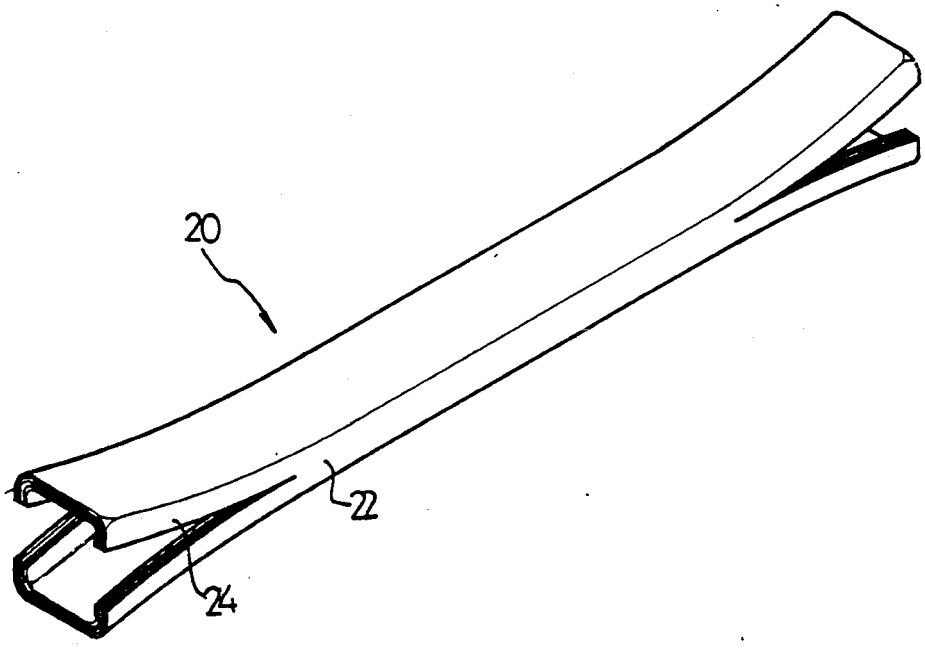
FIG. 3 is a perspective view of the shell.
Figure 4:
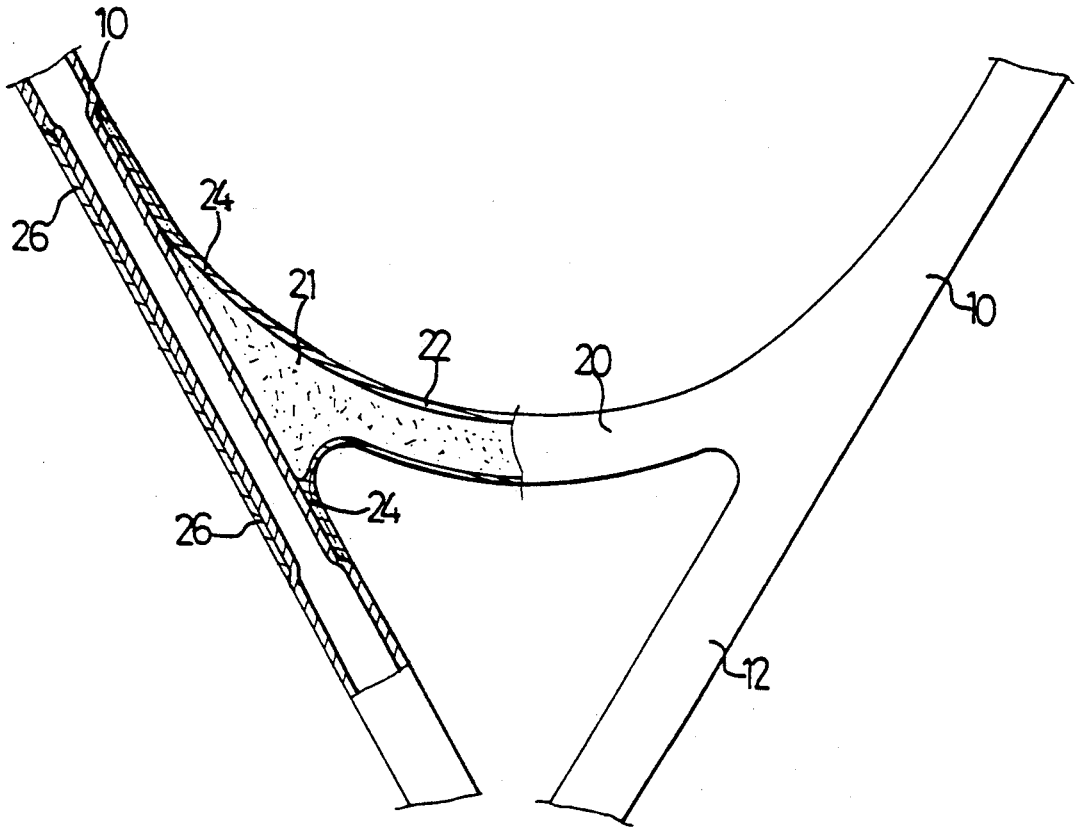
FIG. 4 is a partial cross sectional view of the throat portion of the tennis racket.
Figure 5:
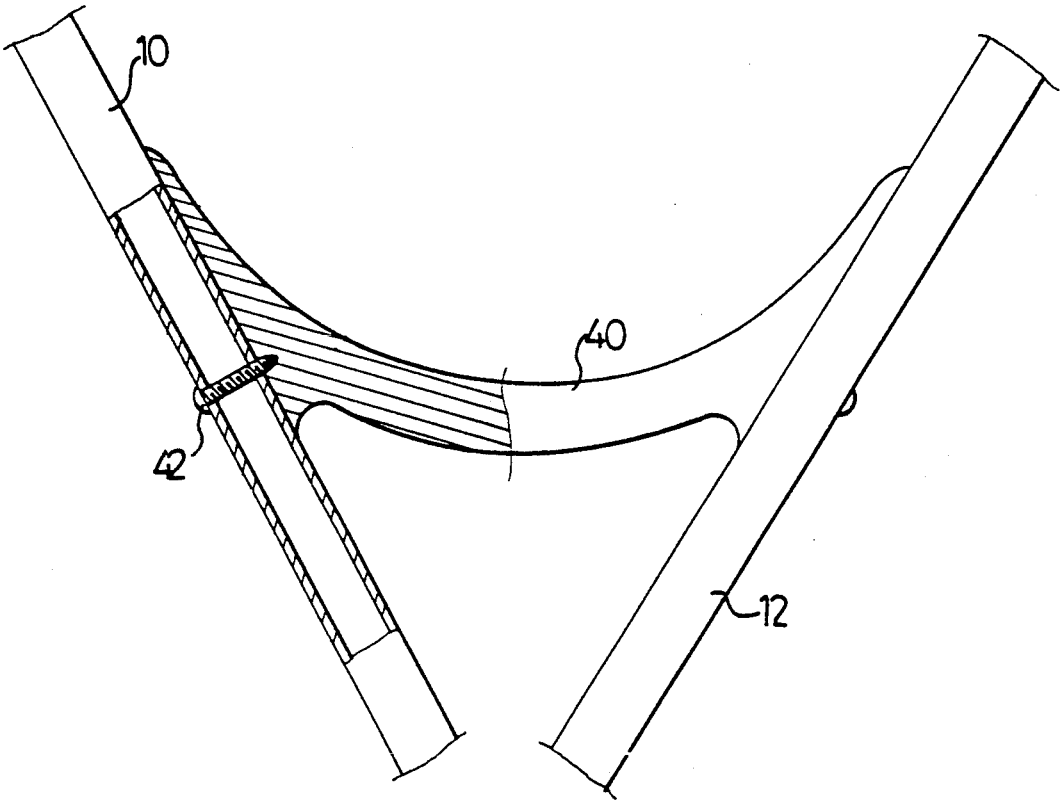
FIG. 5 PRIOR ART
FIG. 5 is partial cross sectional view of the throat portion of a conventional tennis racket.

Referring next to FIGS. 2, 3 and 4, the method is initiated by preparing a foamable material 21 which is substantially strip shaped. One type of the foamable material 21 is ethylene-vinyl acetate copolymer (abbreviated as EVA). The foamable material 21 is surrounded by a shell 22 comprising a plurality of layers 23 each made of a sheet of composite fiber, such as graphite fiber, glass fiber, boron fiber etc., which is unidirectionally oriented and resin-coated. Alternatively, the shell 22 includes a plurality of layers which are formed by a sheet of composite materials wrapped around the foamable material 21.

After the shell 22 of the yoke 20 is formed, each end of the shell 22 is cut or split so that a pair of pieces 24 are formed on each end of the shell 22. The pieces 24 are attached to the inner sides of the sloping frame extensions at the throat portion 10 and are coupled to the sloping frame extensions by an outer layer of composite materials 26 which is wrapped around the pieces 24 and the sloping frame extensions.

After the yoke 20 is coupled to the sloping frame extensions by the outer layer 26, the racket is arranged in a mold for a hot-pressing molding process. The assembled mold has placed in a press, heated to about 150° C. and held for 15 minutes to cure the article. A pressure of about 120 kg/cm$^2$ is applied and maintained on the mold during curing. The the mold is opened and the part removed. The mold is capable of withstanding the internal forces caused by the pressure developed in the curing cycle. The sloping frame extensions of the racket at the throat portion 12 is deformed for receiving the outer layer 26 so that the sloping frame extensions have a flush and smooth outer surface. Alternatively, during the hot-pressing process, the sloping frame extensions of the racket at the throat portion 12 will be deformed when the outer layer 26 is pressed toward the sloping frame extensions at the throat portion 12 of the racket so that the sloping frame extensions have a flush and smooth outer surface.

Accordingly, with the method in accordance with the present invention, the yoke 20 can be integrally formed with the sloping frame extensions at the throat portion of the racket. In addition, no seams will be formed between the yoke and the sloping frame extensions of the racket.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for manufacturing a throat portion of an aluminum racket frame, said frame having an approximately oval-shaped head portion terminating in a pair of closely spaced sloping extensions forming said throat portion of said racket frame; said method comprising the steps of preparing a foamable material; wrapping a composite material and resin-coated shell around said foamable material, said wrapped shell including two end portions; splitting each of said end portions of said wrapped shell, thereby forming a pair of pieces on each end portion of said wrapped shell; attaching said pieces of each of said end portions of said wrapped shell to an inner surface of a respective sloping extension at said throat portion of said aluminum racket frame; wrapping around said pieces of said end portions of said shell and said sloping extensions with an outer layer which is made of a composite material and resin-coated; hot-pressing said aluminum racket frame, said outer layer and said shell, thereby foaming said foamable material and curing said outer layer and said shell, thereby forming said outer layer and said shell integral with said aluminum racket frame as a yoke of said aluminum racket frame.

* * * * *